United States Patent [19]

Carlsson

[11] Patent Number: 4,530,201

[45] Date of Patent: Jul. 23, 1985

[54] METHOD AND AN APPARATUS FOR PACKAGING ARTICLES IN INDIVIDUAL WRAPPINGS

[76] Inventor: Halvard I. Carlsson, Egnahemsvågen 6, S-445 00 Surte, Sweden

[21] Appl. No.: 337,504

[22] Filed: Jan. 6, 1982

[30] Foreign Application Priority Data

Feb. 17, 1981 [SE] Sweden ..... 8101059

[51] Int. Cl.[3] ..... B65B 11/00

[52] U.S. Cl. ..... 53/397; 53/412; 53/442; 53/479; 53/557; 53/580; 53/594

[58] Field of Search ..... 53/142, 390, 391, 397, 53/412, 442, 479, 550, 552, 557, 580, 594; 198/656, 817; 426/90, 91, 95, 101, 115, 130, 132, 139, 410; 493/193, 194

[56] References Cited

U.S. PATENT DOCUMENTS

| | | | |
|---|---|---|---|
| 2,547,835 | 4/1951 | Pfeiffer | 53/397 |
| 2,909,877 | 10/1959 | Cummings et al. | 53/594 |
| 3,004,651 | 10/1961 | Manspeaker et al. | 198/817 X |
| 3,084,781 | 4/1963 | Merrill | 198/656 X |
| 3,138,239 | 6/1964 | Ackerman et al. | 198/817 X |
| 3,233,386 | 2/1966 | Burke | 53/557 X |
| 3,234,072 | 2/1966 | Dreeben | 53/552 X |
| 3,324,625 | 6/1967 | Dulmage | 53/557 X |
| 3,508,380 | 4/1970 | Nakamura | 53/442 X |
| 3,522,689 | 8/1970 | Wylie et al. | 53/552 |
| 3,599,538 | 8/1971 | Piazze | 493/194 |
| 3,735,551 | 5/1973 | Pratt | 53/433 |
| 3,892,060 | 7/1975 | Stanley | 53/552 X |
| 4,230,223 | 9/1978 | Flajnik | 198/817 |

FOREIGN PATENT DOCUMENTS 1552902 12/1968 France .

*Primary Examiner*—John Sipos
*Assistant Examiner*—Steven P. Weihrouch
*Attorney, Agent, or Firm*—Harness, Dickey & Pierce

[57] ABSTRACT

A method and device for packaging essentially conical objects, particularly ice-cream cones, in individual wrappings. The ice-cream cones (1) are advanced with the aid of holder members (7). A web (11) of shrinking foil is folded over the cones. The ice-cream cones are advanced up to two wheels (12, 13) formed with cogs (14). On the cogs of one of the wheels two jaws (15) and a heating wire (16) are provided. The opposite wheel (13) is formed on its cogs (14) with a back-up surface. When the ice-cream cones reach the wheels (12, 13) the foil is compressed between the cogs (14) and burnt off by the heating wire while at the same time vertical edges are formed in the foil and fused together in such a manner that individual wrappings are formed about each ice-cream cone (1). Hot air is finally blown against the part of the wrapping that is positioned below the cone edge so that this part of the wrapping is shrunk onto the ice-cream cone and the wrapping securely retained thereon.

9 Claims, 2 Drawing Figures

METHOD AND AN APPARATUS FOR PACKAGING ARTICLES IN INDIVIDUAL WRAPPINGS

BACKGROUND OF THE INVENTION

The subject invention concerns a method and an apparatus for packaging articles in individual wrappings which articles at least over part of their extension have a conical shape. The invention is particularly applicable in packaging ice-cream cones.

Ice cream cones are usually packaged individually, that is one by one, and generally the work is performed manually. Plastic bags are produced in advance and are applied manually over the individual ice-cream cones. Obviously, this method is inefficient and time-consuming.

SUMMARY OF THE INVENTION

The subject invention is concerned with a method and an apparatus by means of which ice-cream cones may be packaged in individual wrappings in an efficient and simple manner. In addition, the wrappings are designed to be easily removable by the consumer.

The method in accordance with the invention for packaging essentially cone-shaped articles in individual wrappings is characterised by the steps of applying a web of a continuously supplied shrinking foil over the articles and advancing said foil web together with said articles with the lengthwise edges of said foil web on either side of said articles extending down over the cone-shape portions of said articles, severing the foil web intermediate each article into foil portions by fusing together and burning off the foil ahead of and behind the articles as seen in the direction of advancement of the latter, such that the foil portions form individual wrappings enclosing the discrete articles, and heating at least a part of the part of each individual wrapping that covers the cone-shaped part of the article or that portion of the article that projects above the cone-shaped part thereof, whereby said wrapping will be heat-shrunk about said article.

The apparatus for performing the method in accordance with the invention is characterised by an advancement mechanism arranged to advance the articles in an upright position in a mutually spaced relationship, by means for severing into foil portions a web of shrinking foil applied over the articles such that one lengthwise edge of the foil web projects further down than the opposite edge thereof, said severing effected by jointly fusing together and burning off the foil, ahead of and behind the articles as seen in the direction of advancement, and by a conduit supplying hot gas, said conduit arranged to direct a stream of hot gas against said foil, whereby the latter is shrunk onto the article.

Further characteristics of the invention and the advantages gained thereby will become apparent from the following description and the appended claims.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

Figure 1:
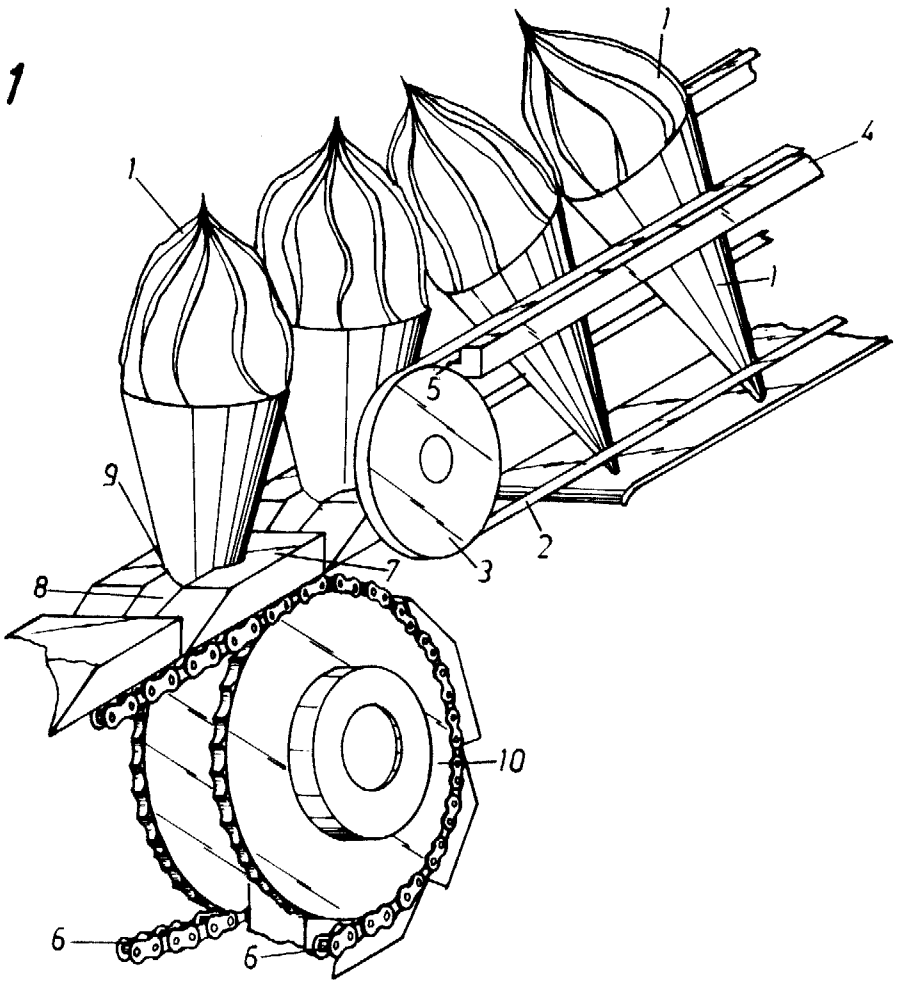
FIG. 1 is a view as seen obliquely from above, showing a part of the apparatus in accordance with the invention.
Figure 2:
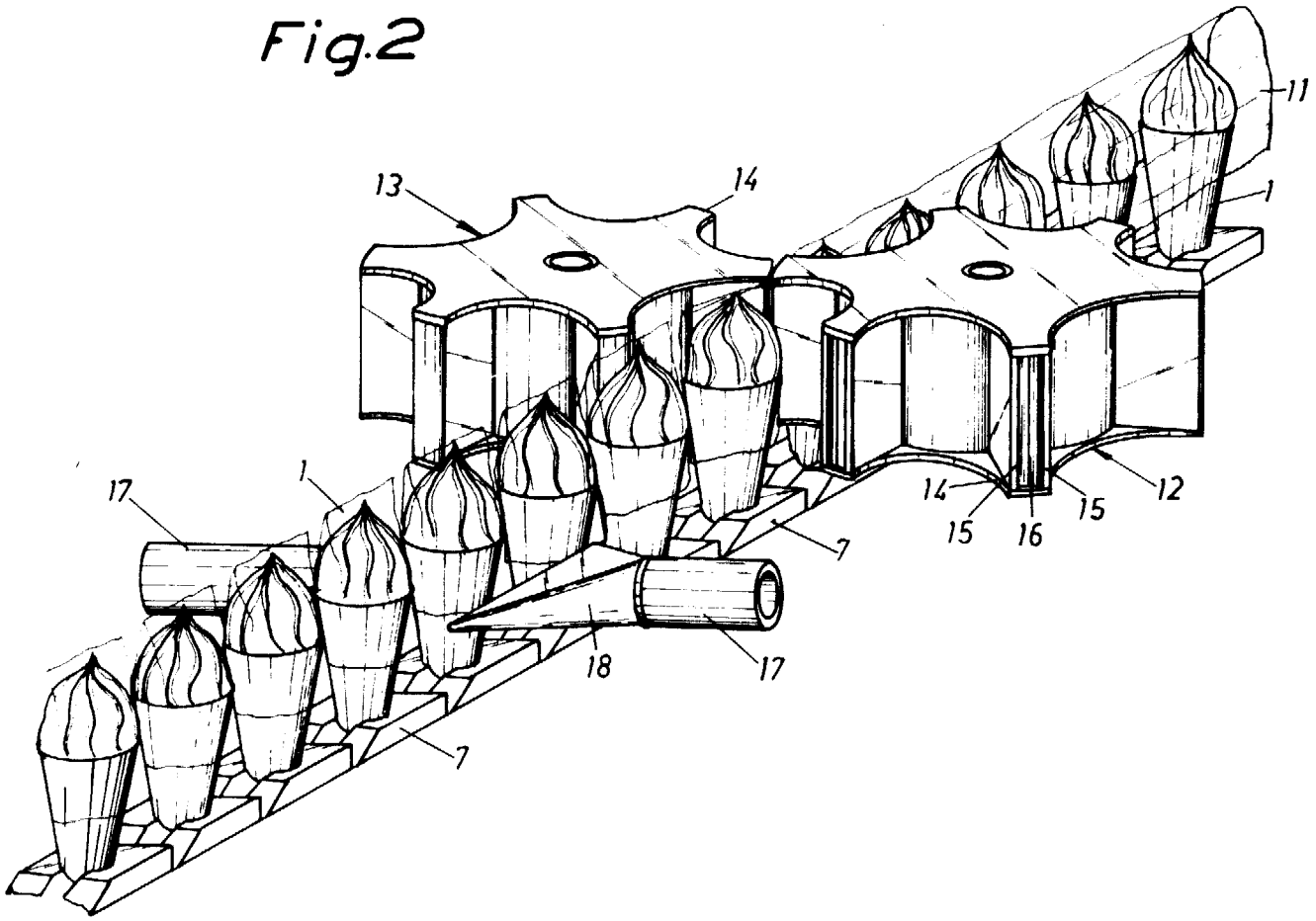
FIG. 2 is a view also seen obliquely from above and showing the principle of function of the apparatus in accordance with the invention.

Ice-cream cones 1 are advanced by means of two belts 2. The belts are driven by two wheels 3 and run along wooden rails 4 in which grooves 5 are formed. At the end of the belt-drive unit the ice-cream cones reach a chain-drive advancement unit. The latter consists of two chains 6 on which are secured a number of holder members 7 having a wedge-shaped leading edge. Each holder member is formed with a groove 8 and a hole 9, the latter having a conical shape corresponding to the shape of the ice-cream cones. The chains 6 travel about wheels 10.

When the ice-cream cones 1 reach the end of the belt-drive unit, one of the holder member 7 will engage the ice-cream cone from underneath and lift it off the belt-drive unit. This is achieved as illustrated in FIG. 1 owing to the position of the chain wheels 10 at the end of the belt-drive unit and to the holder members, which are returned on the lower part of the chain-drive unit, swinging into position at the gap joining the belt-drive unit and the chain-drive unit.

The construction and the mounting of the chain 6 is such as to ensure that the ice-cream cones 1 are conveyed in an upright position and spaced a predetermined distance apart. A web of shrinking foil 11 is applied over the ice-cream cones in the direction of the advancement mechanism. The foil web covers the part of the ice-cream cones that projects above the cone itself. One lengthwise marginal edge of the foil web hangs further down than does the opposite marginal edge, so that there is some displacement between the two edges.

The advancement unit feeds the ice-cream cones 1 up to two horizontally positioned wheels 12 and 13 which are provided with cogs 14. At the cog apices of one 12 of said wheels two parallel jaws 15 are mounted so as to be allowed to move between retracted and projecting positions. Sandwiched between the jaws 15 is a heating wire 16. The opposite wheel 13 is formed simply with a flat surface at the apices of its cogs 14, these surfaces serving as a back-up surface to the jaws on the opposite wheel 12. The movements of the wheels 12, 13 are synchronized and are also in synchrony with the advancement movement of the advancement mechanism, which ensures that the cogs 14 on the two wheels 12, 13 will be positioned in exact opposite relationship between each ice-cream cone.

When the cogs 14 are opposite one another they compress the foil 11 between them. The jaws 15 abut the back-up surface on the wheel 13. As a result, the foil 11 is retained in position and is burnt off by the heating wire 16. In the process of this burning-off operation fused-together vertical edges will be formed in the foil ahead of and behind each individual cone, whereby each ice-cream cone will be enclosed in its individual foil wrapping.

After having passed the two wheels 12, 13 the ice-cream cones 1 are moved to a shrinking-foil heating station. This station comprises two conduits or tubes 17 with associated nozzles 18. Hot air is blown through the tubes against the part of the shrinking foil that is positioned below the upper edge of the wafer part of the cone. In this manner, the wrapping will be shrunk onto the lower part of the cone and prevented from sliding off the latter. In addition, the ice-cream is protected against the effect of the hot air by the wafer of the cone and therefore will not melt.

The individual wrappings are easy to remove, because the lower edges of the wrappings are positioned at different levels, allowing the consumer to tear off the wrapping very easily.

The embodiment of the invention described above is to be regarded as one example only and a variety of modifications are possible within the scope of the appended claims. Instead of the two wheels 12, 13 designed to sever the foil and fuse together the foil edges to form the individual wrappings, two reciprocating arms may be used to perform the same function. In this case, jaws and a heating wire are provided at the arm edges that move into contact with one another.

It should be obvious that it is possible to make use of the invention also to enclose objects of other configuration than cone-shaped, provided they have a projecting edge or other surface that can serve as an attachment. In this manner, the invention can advantageously be used to enclose cans and similar packages containing foodstuff. Owing to this arrangement the customer can check that the package has not been tampered with or opened, since if this had been the case the plastics foil would have been damaged.

What I claim is:

1. An improved method of packaging articles such as ice cream cones having conical bases formed with upwardly diverging walls and a softer filling in their upper end in individual wrappings, the improvement comprising the steps of applying a single web of a continuously supplied shrinking foil over the top of said articles and draping down their sides and advancing said foil web together with said articles with the lengthwise edges of said foil web on either side of said articles extending down over the conical portions of said articles, severing said foil web intermediate each one of said articles into foil portions by fusing together and burning off the downwardly extending position of said foil ahead of and behind said articles as seen in the direction of advancement of said articles, such that said foil portions form individual wrappings relatively loosely enclosing the discrete articles, and heating only a lower part of the part of each individual wrapping that covers said conical part of said articles, whereby said wrapping will be heat-shrunk about the lower portion of said article and leaving the remaining part relatively loosely enclosed.

2. An improved method as claimed in claim 1, comprising applying said foil web over said articles in such a manner that one of the lengthwise edges of said web extends further down along said articles than does the opposite edge thereof.

3. An improved method as claimed in claim 1 for packaging filled ice-cream cones, comprising directing hot air used to shrink said foil of the individual packages against an area below the top edge of said cone, so as to ensure that said ice-cream remains unaffected by said hot air.

4. An improved method as claimed in claim 1, wherein said articles are formed with an area adjacent and below the top edge of the conical base and wherein that portion of said foil that covers said area of said articles is heated to heat-shrunk said wrapping about said articles.

5. An improved apparatus for packaging articles such as ice cream cones having conical bases formed with upwardly diverging walls and a softer filling in their upper end in individual wrappings, comprising an advancement mechanism for advancing said articles in an upright position in a mutually spaced relationship, said articles having a single web of shrink foil applied over the top of said articles and draping down their sides with the lengthwise edges of said foil web on either side of said articles extending down over the conical portions of said articles means for joining and severing into foil portions said web of shrinking foil over said articles, said foil web being arranged over said articles in such a manner that one of the lengthwise edges of said foil web projects further down than does the opposite edge thereof, said severing means comprising means for fusing together and burning off the downwardly extending portions of said foil ahead of and behind said articles as seen in the direction of advancement to thereby loosely enclose said articles, and a conduit means supplying hot gas, said conduit arranged to direct a stream of hot gas against only the lower portion of said foil, shrinking said foil onto said article at the lower portion of said foil while leaving the remaining portion relatively loose.

6. An apparatus as claimed in claim 5, comprising a plurality of holder members, each member formed with a vertical hole complimentary to the conical portion of the article and a groove extending in the direction of advancement and terminating at said hole, said holder member provided on chains for advancement of said articles.

7. An apparatus as claimed in claim 5, comprising two wheels positioned one on either side of the path of advancement of said articles, a number of cogs formed on each one of said wheels, said wheels arranged to rotate in the horizontal plane and positioned one on either side of the path of advancement of said articles, heating wires and jaws on the cog apices of at least one of said wheels, each heating wire sandwiched between a couple of said jaws, said jaws arranged for movement between a retracted and a projecting position, said wheels so arranged that upon advancement of said articles and rotation of said wheels said cog apices of said wheels move into abutment against one another, the jaws compressing said foil and said heating wire severing said foil, thus forming individual wrappings.

8. An apparatus as claimed in claim 7, comprising one of said wheels provided on its cog apices with said heating wires and with said jaws surrounding said wires, the opposite wheel provided on its cog apices with jaw back-up surfaces.

9. An apparatus as claimed in claim 7, for use in packaging ice-cream cones, comprising a belt-drive unit for advancement of said ice-cream cones, said belt-drive unit comprising two belts arranged to advance said ice-cream cones forwards, a plurality of holder members, each member formed with a hole and a groove, chains supporting said holder members, said holder members arranged to convey said ice-cream cones further, after the end of said belt-drive unit.

* * * * *